United States Patent [19]

Ambasz et al.

[11] 4,345,733

[45] Aug. 24, 1982

[54] MOUNTING DEVICE FOR A CHAIR SEAT

[75] Inventors: Emilio Ambasz, New York, N.Y.; Giancarlo Piretti, Bologna, Italy

[73] Assignee: Center for Design Research and Development N.V., Curacao, Netherlands Antilles

[21] Appl. No.: 144,261

[22] Filed: Apr. 28, 1980

[51] Int. Cl.[3] ..... F16M 13/00

[52] U.S. Cl. ..... 248/561; 248/596

[58] Field of Search ..... 248/561, 573, 598, 596

[56] References Cited

U.S. PATENT DOCUMENTS

| | | | |
|---|---|---|---|
| 2,132,305 | 10/1938 | Lescalleet | 248/598 X |
| 2,729,273 | 1/1956 | Hamilton et al. | 248/596 X |
| 3,185,430 | 5/1965 | Bernard | 248/596 X |
| 4,013,258 | 3/1977 | Doerner | 248/596 X |
| 4,131,260 | 12/1978 | Ambasz | 248/599 X |

FOREIGN PATENT DOCUMENTS

| | | | |
|---|---|---|---|
| 180474 | 6/1922 | United Kingdom | 248/596 |

*Primary Examiner*—Dave W. Arola

*Attorney, Agent, or Firm*—Brumbaugh, Graves, Donohue & Raymond

[57] ABSTRACT

A chair seat mounting device comprises a platelike support bracket that can be fastened to a chair base and a mounting plate that can be fastened to the underside of the chair seat. The plate automatically tilts forward on an axle on the bracket when the person sitting in the chair leans forward and his or her weight overcomes a spring mechanism that yieldably restrains the seat in the normal, upright position.

4 Claims, 6 Drawing Figures

MOUNTING DEVICE FOR A CHAIR SEAT

FIELD OF THE INVENTION

The present invention relates to office seating, and in particular, to a mounting device for the seat of an office chair which allows the seat to tilt forward automatically when the person sitting in it leans forward, such as to work at a desk or other working surface, and which, preferably, can also be locked in the forward tilt configuration.

BACKGROUND OF THE INVENTION

Ever-increasing numbers of people have jobs which require them to work long hours at a desk or other work surface. Many conventional desk chairs are designed to be comfortable when the person sitting in them is in an upright position and to tilt back so the person can relax back from time to time to rest, but when the person leans forward in such chairs, the front of the seat presses into the backs of his or her thighs, and the entire posterior is no longer comfortably supported.

Recently, the need to make office seating, especially the category of office seating sometimes called operational seating, more comfortable in a leaning-forward posture has become more widely recognized, and operational chairs which tilt forward are now on the market. Among them are the highly successful "Vertebra" chairs which have seat mounting mechanisms embodying the invention of U.S. Pat. No. 4,131,260.

SUMMARY OF THE INVENTION

There is provided, in accordance with the present invention, a mounting device for a chair seat which normally restrains the seat in a position comfortable to a person sitting in an upright posture but which permits the seat to tilt forward automatically when the person leans forward, for example, to work at a desk or table. The mounting device comprises a generally plate-like support bracket which is adapted to be mounted generally horizontally on a chair base and which has a transverse horizontal axle. A seating mounting member is attached to the axle to pivot about the axis of the axle and is suitably constructed to be fastened to the underside of the chair seat. Mutually engageable surfaces on the support bracket and mounting member spaced apart from the axle limit rearward tilting of the member on the bracket and establish the normal, upright position of the chair seat. A spring assembly is connected between the bracket and member and yieldably restrains the member from tilting forward about the axle. The spring assembly includes a connecting pin extending down from the mounting plate at a location some distance to the rear of the axle and carrying a retainer at its lower end and a compression spring engaged between the retainer and a spring seat on the underside of the support bracket.

In a preferred embodiment of the present invention, the spring retainer on the connecting pin is a cup which has walls surrounding the lower part of the spring and the spring seat on the bracket is defined by a second cup which has walls surrounding the upper part of the spring. The walls of the two cups are telescopically related and the two cups visually conceal the spring. Preferably, the lower portion of the connecting pin is threaded, and the spring retainer cup has a central boss which is correspondingly threaded and by rotating it can be moved up or down along the lower portion of the pin for adjustment of the spring force.

The connecting pin carries a stop disc at a location which is normally below the spring seat. The stop disc engages the spring seat upon predetermined forward tilting of the seat mounting member to limit the amount of forward tilting of the seat on the chair base.

As an optional, but desirable, feature, a manually operated blocking member is selectively engageable between the bracket and the seat mounting member when the seat is tilted forward to keep the seat tilted forward.

The mounting device, according to the present invention, is of relatively simple construction which reduces the cost of manufacture and increases reliability. It is of small size, and because the bracket and seat mounting member are predominantly flat plates, at least in preferred designs embodying the invention, the device is visually concealed, for the most part, by the chair seat. In designs which include the preferred, but optional, adjustable spring mechanism, and the blocking member for keeping the seat in the tilted-forward configuration, the adaptability of the seat mount to the preferences of various individuals in respect of the movement of the seat between the upright and tilted-forward positions is highly advantageous For a better understanding of the invention, reference may be made to the following description of exemplary embodiments, taken in conjunction with the figures of the accompanying drawings.

DESCRIPTION

Figure 1:
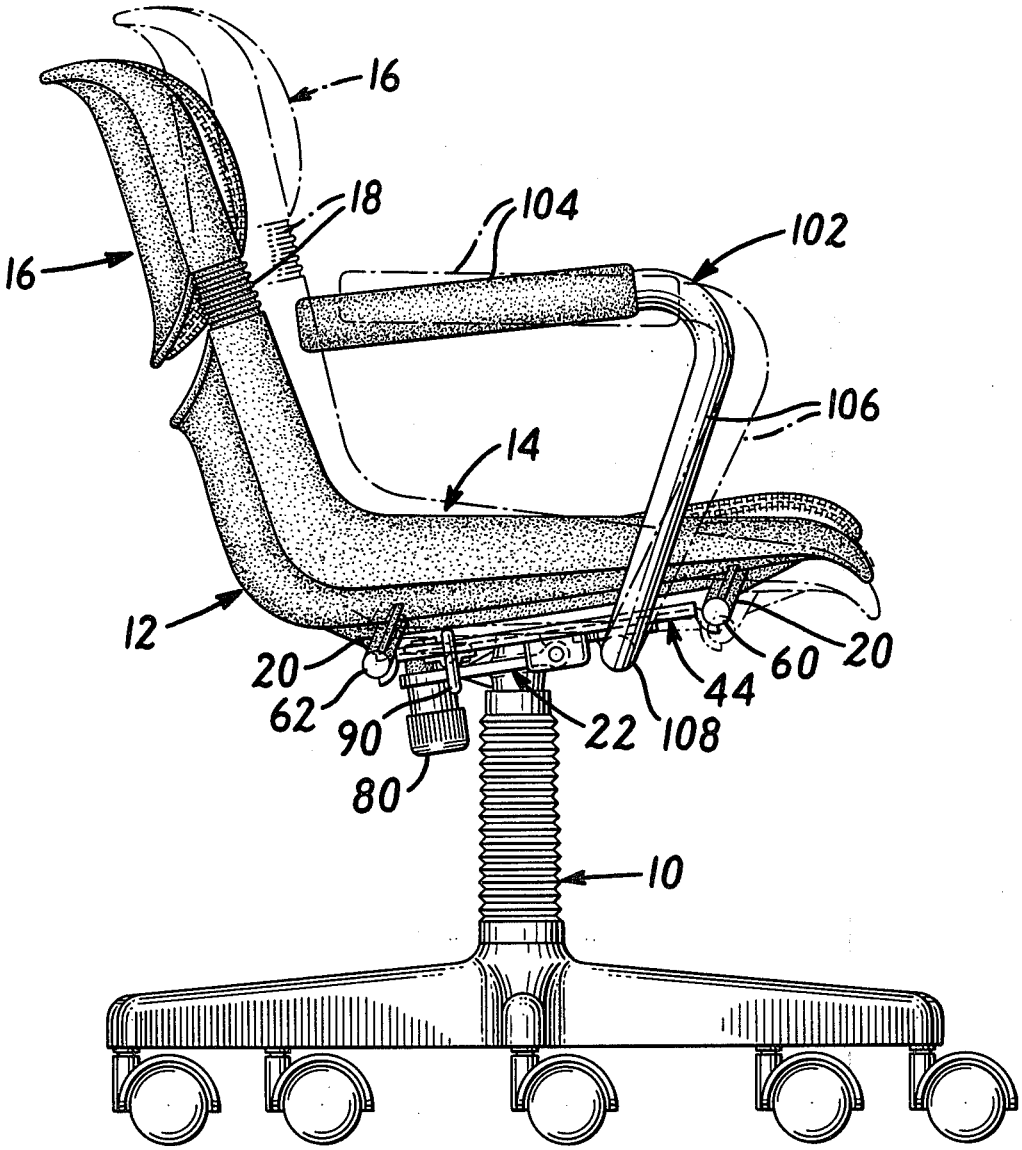
FIG. 1 is a side elevational view of a complete chair in which the invention is used to mount the seat on a caster base.

The mounting device, according to the invention, can be used to mount various chair seats on various types of bases. In the example shown in FIG. 1, the chair comprises a five-legged caster base 10 and a seat and back structure 12 which consists of a unitary molded plastic seat and lower back 14 and an upper back 16 attached at each side to the seat and lower back component 14 by articulating linkages fitted in sockets and concealed within flexible bellows 18. The underside of the component 14 has four small projections or bosses 20 (a front pair and a rear pair, those of each pair being located symmetrically a suitable distance on either side of the fore-aft center line). The seat structure 12 is attached to the mounting device by screws (not shown) inserted into the boasses 20. The above-described seat 12 is the subject of U.S. patent application Ser. No. 56,790, filed July 11, 1979 which is owned by the assignee of the present invention.

Figure 2:
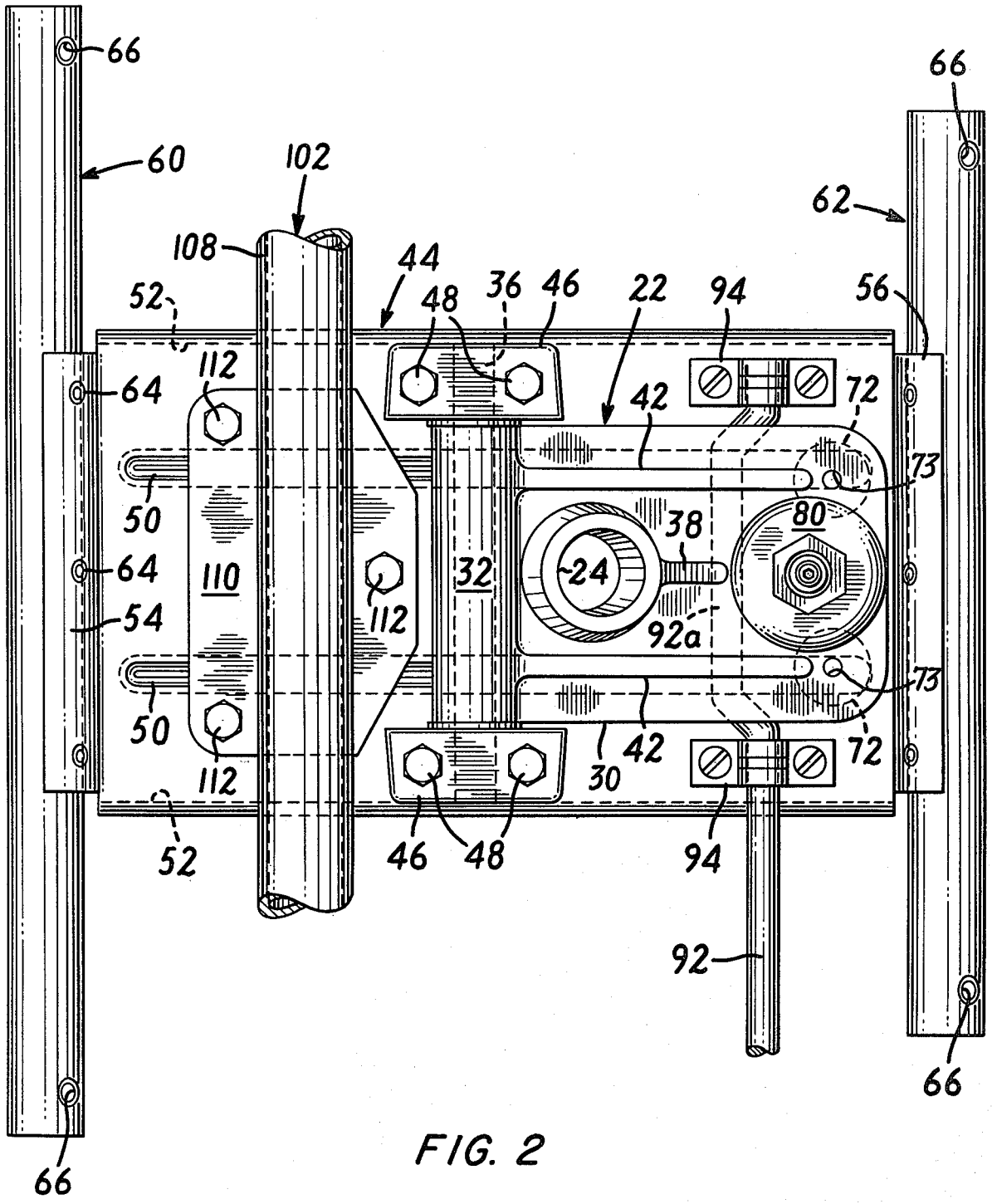
FIG. 2 is a bottom view of the seat mounting device.
Figure 3:
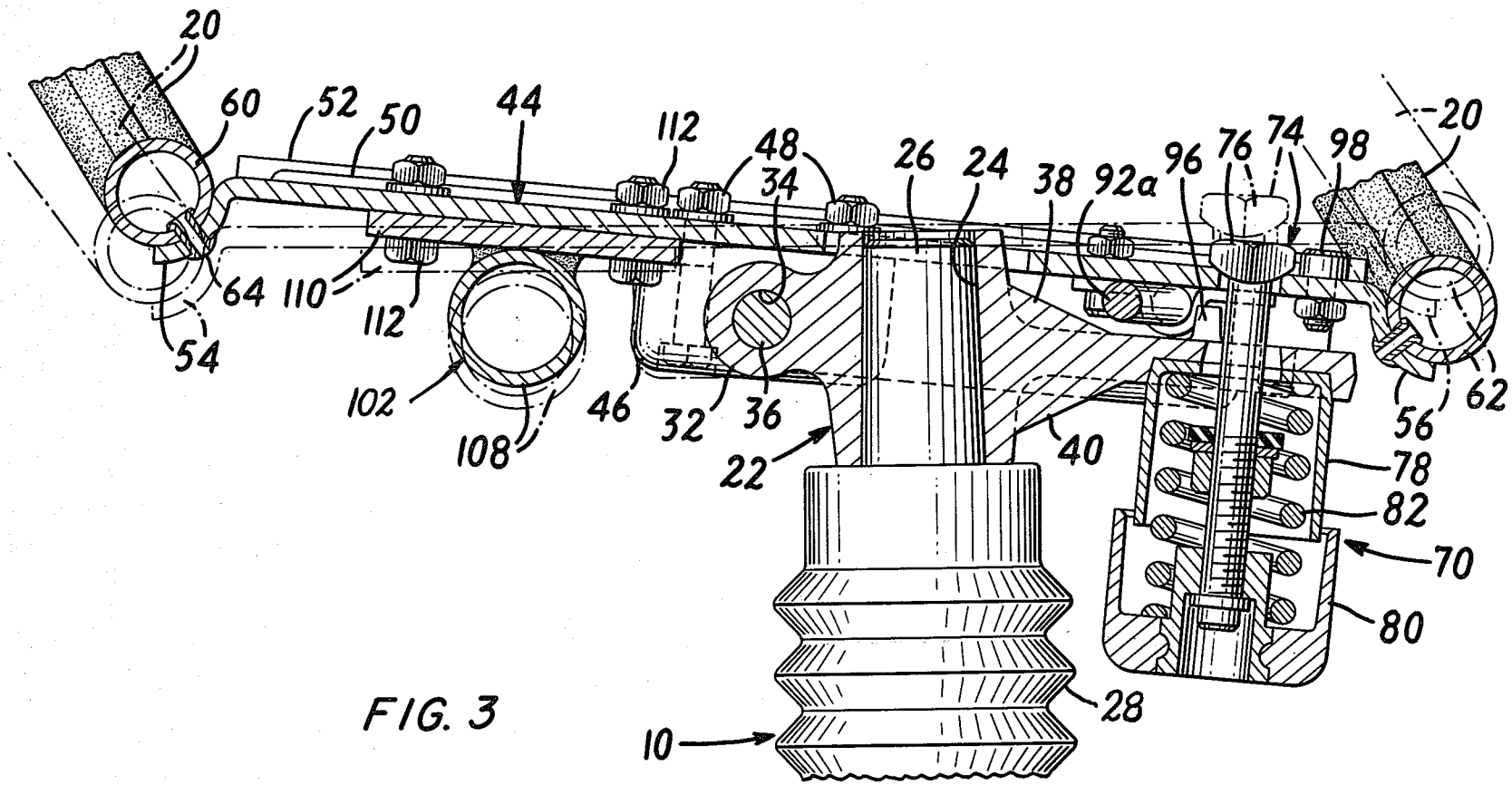
FIG. 3 is a side view in cross section of the seat mounting device.

As shown in FIGS. 2 and 3, the mounting device comprises a support bracket 22 having a slightly tapered socket 24 which accepts the upper end portion 26 of the column 28 of the pedestal base. The support bracket is a metal casting of special configuration which includes a rearwardly extending plate-like web portion 30 and a transverse boss 32 in front of the socket 24 which has a transverse hole 34 fitted with an axle 36. The bracket is strengthened by stiffening ribs (e.g., 38, 40 and 42).

A seat mounting plate 44, which is, preferably, a stamping produced from relatively heavy-gauge steel, is attached by the axle 36 to the support bracket 22 by means of a pair of fittings 46 fastened by bolts 48 to the underside of the plate 44. The rigidity of the plate 44 is enhanced by forming lengthwise ribs 50 over most of the length of the plate and by means of upturned flanges 52 along each side. Front and rear seat mounting tubes 60 and 62, respectively, are fastened by rivets 64—they can, of course, also be bolted, welded or formed integrally with the mounting plate—to arcuate flanges 54 and 56 at each end of the mounting plate 44. Each mounting tube 60 and 62 has a hole 66 near each end for the screws (not shown) which are threaded into the bosses 20 on the underside of the seat and fasten the seat structure 12 to the mounting device.

Figure 4:
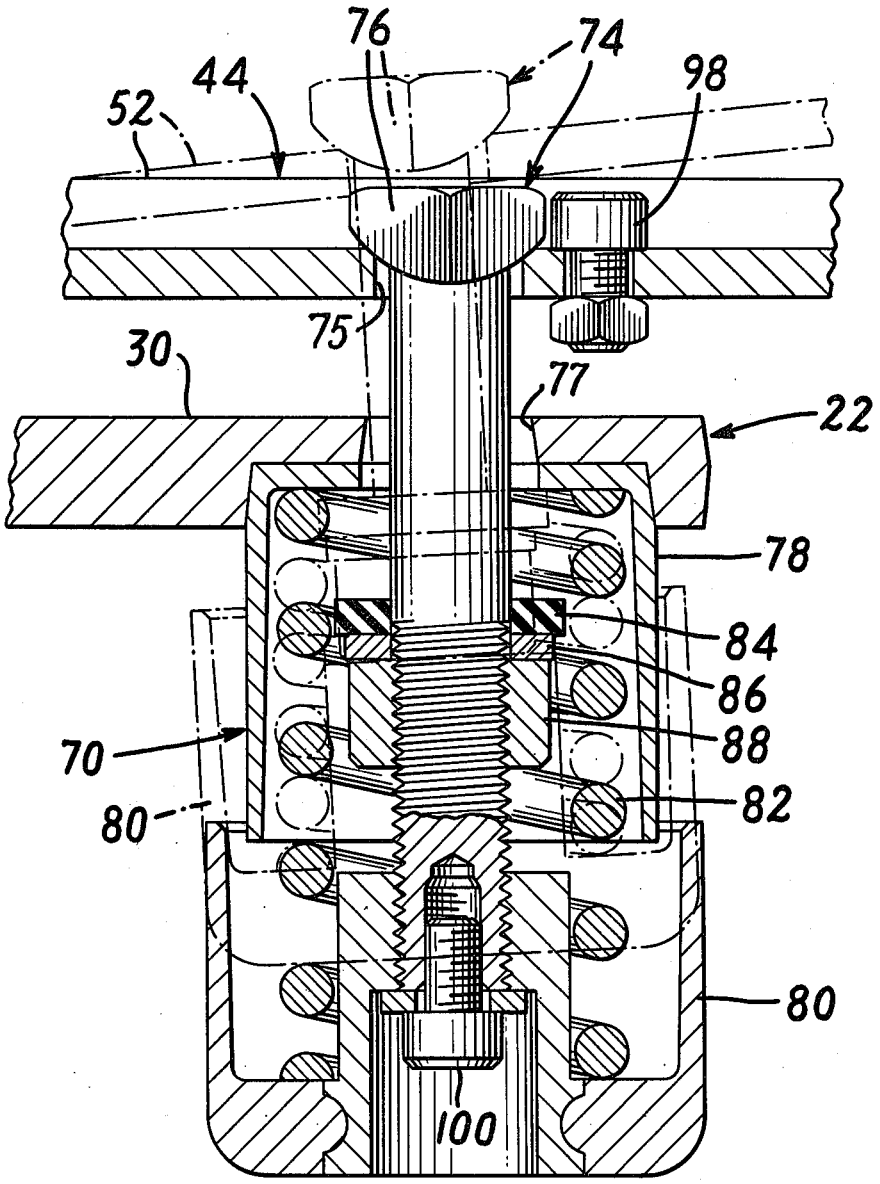
FIG. 4 is an enlarged side view in cross section of the spring adjusting mechanism.

The seat mounting plate 44 is restrained from pivoting about the axle 36 and is retained in a position that establishes the normal upright position of the seat structure 12 by an adjustable spring assembly 70. In the normal position the rear part of the mounting plate rests on rubber spacers 72 attached by bosses that fit into holes 73 in the rear portion 30 of the support bracket. A connecting pin 74 projects down through a hole 75 in the rear portion of the mounting plate and a hole 77 in the rear portion 30 of the support bracket. A head portion 76 of the pin has a spherical undersurface (see FIG. 4) which rests on the perimeter of the hole in the mounting plate so that the pin 74 is self-seating and can pivot. The lower portion of the pin 74 extends downwardly below the rear portion 30 of the support bracket into and through an upper spring retainer cup 78 and is threaded at its lower end to receive a correspondingly threaded adjustable lower spring retainer cup 80. A compression sring 82 compressed between the retainer cups 78 and 80 pulls downwardly on the pin 74 and yieldably holds the rear portion of the mounting plate in a downward, normal position in which the axle 36 and rubber stops 72 stably support the seat structure 12 in a normal position, i.e., the position shown in solid lines in FIG. 1 in which the seat bottom 14 has a comfortable, slightly rearward incline.

When a person sitting in the chair leans forward, for example, to write at a desk or perform other operations which are most comfortably or necessarily performed in a leaning-forward posture, the seat mounting device automatically responds to the shifting of the center of gravity of the person to a more forward location, relative to the seat, by tilting forward about the axle 36, which requires that the rear part of the mounting plate 44 lift up relative to the bracket 30. The spring 82 yields and is compressed as the pin 74 pulls the lower retainer cup 80 upwardly. The forward tilting of the seat structure 12 stops when a rubber stop washer 84 held on the pin 74 by an ordinary washer 86 and a retainer nut 88 threaded on the pin 74 engage the end wall of the upper spring retainer cup 78. The mounting device greatly improves the comfort of the chair to a person who leans forward by lowering the front end of the seat and reducing the pressure on the backs of the person's thighs and by lifting the rear portion of the seat and moving the back forward for improved support. When the person sitting in the chair leans back, the resulting change in his center of gravity and the force in the sring 82 restore the seat structure 12 to the normal position.

If the person sitting in the chair plans to spend a relatively long time leaning forward to work over a desk or in some other situation, he may wish to lock the seat structure in the forward position (the phantom lines in FIG. 1) so that even if he leans back the chair will retain the forward-tilted position. In that event, he can reach down and turn an operating handle 90 fastened on the end of a lock bar 92 which is mounted to pivot on the underside of the rear portion of the mounting plate 44 by a pair of retainer clips 94. The locking bar 92 has a laterally offset portion **92*a* which (as shown in FIGS. 2 and 3) normally lies flat against the underside of the mounting plate in the unlocked position but which pivots downwardly and rearwardly when the handle 90 is urged clockwise, as viewed in FIG. 1, and bears against upwardly projecting stops 96 on the rear portion 30** of the support bracket and thus locks the mounting plate in the forward-tilted position.

The spring mechanism 70 can be adjusted to yield at various levels of force by rotating the threaded lower cup 80 axially up or down along the pin 74. The head 76 of the pin 74 has facets on its perimeter, and a nut and screw 98 are installed in the mounting plate immediately adjacent the head 76 and keep the pin 74 from rotating when the lower cup is turned. A screw and washer 100 prevent the calibration cup 80 from being completely unthreaded from the rod and there is sufficient spacing between the calibration cup 80 and the nut 88 to provide a wide range of spring forces to accommodate the weight and the personal wishes of the person who uses the chair in respect of yielding of the seat mounting structure to a leaning-forward posture.

The mounting device includes a provision for attachment of optional arms 102 on the chair. As shown in FIG. 1, the arms 102 are parts of a metal tube which is bent to provide armrest portions that are fitted with molded armrests 104 and side portions 106 which curve downwardly and slightly rearwardly from each armrest portion and which then curve transversely inwardly to provide a transverse ortion 108 extending entirely across the underside of the front portion of the mounting plate 44. A plate 110 is welded (or otherwise suitably secured) to the transverse portion 108 of the arms 102, and the plate and arms are bolted by bolts and nuts 112 to the mounting plate.

Figure 5:
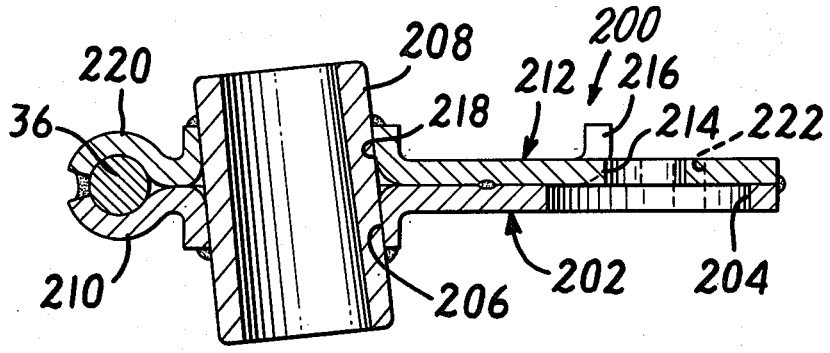
FIG. 5 is a side view in cross section of a modified form of support bracket.
Figure 6:
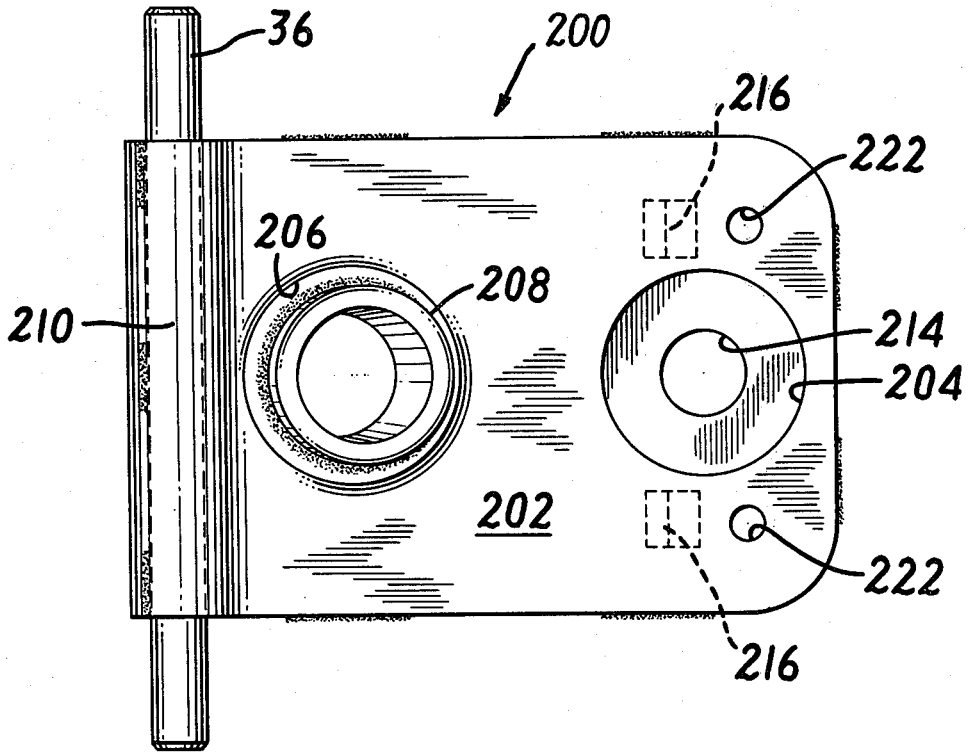
FIG. 6 is a top view of the support bracket shown in FIG. 5.

Instead of manufacturing the support bracket 22 as a casting, as shown in FIGS. 1 to 4, it can be made from a pair of plates stamped from heavy-gauge sheet metal and a sleeve, as shown in FIGS. 5 and 6. The support bracket 200 comprises a lower plate 202 having a hole 204 in its rearward portion for reception of the upper spring retainer cup, a flanged hole 206 near the front for reception of a sleeve 208 which receives the upper end of the column 28 and an arcuate seat 210 at the front for engagement with the axle 36. The upper plate 212 has a hole 214 for the pin 74, a pair of laterally spaced-apart projections 216 which correspond to the projections 96 of the cast version, a flanged hole 218 for the sleeve 208 and an arcuate seat 220 for the axle 36. The two plates 202 and 212 and the sleeve 208 are welded into a unit. A pair of laterally spaced holes 222 near the back end of the bracket 200 receive bosses on the rubber stops 72.

We claim:

1. A mounting device for a chair seat comprising a generally plate-like support bracket adapted to be mounted generally horizontally on a chair base, a transverse horizontal axle on the support bracket, a seat-mounting member attached to the axle to pivot about the axis of the axle and being adapted to be fastened to the underside of the chair seat, the support bracket and mounting member having mutually engageable surfaces spaced apart from the axle for limiting rearward tilting of the member on the bracket, a spring assembly for restraining the member from tilting forward about the axle, and including a connecting pin connected to and extending down from the mounting member at a location spaced apart rearwardly of the axle, a spring retainer at the lower end of the pin, a hole in the seat-mounting member and support bracket through which the pin passes, a downwardly facing spring seat portion on the bracket, and a compression spring engaged between the spring retainer and the spring seat portion of the bracket, and a blocking member selectively engageable between the bracket and member when the member is tilted forward to keep the member tilted forward, the blocking member being a rod having an offset portion and being pivotably mounted on one of the member and the bracket for movement between an inactive position in which the offset lies generally in a horizontal plane with the pivot axis of the rod and a blocking position in which the offset is vertically displaced from the pivot axis of the rod and in engagement with an abutment on the other of the bracket and member which keeps it in the blocking position.

2. A mounting device according to claim 1 wherein the spring retainer is a cup having walls which surround the lower part of the spring, the spring seat on the bracket is defined by a second cup having walls surrounding the upper part of the spring and wherein the walls of the two cups are telescopically related, whereby the spring is enclosed within the telescoping cups.

3. A mounting device according to claim 1 or claim 2 wherein the lower portion of the connecting pin is threaded and the spring retainer cup has a central boss which is correspondingly threaded and is threaded into the pin for adjustment of the spring force.

4. A mounting device according to claim 1 or claim 2 wherein the connecting pin carries a stop disc at a location which is normally spaced-apart below the spring seat but is adapted to engage the spring seat upon predetermined forward tilting of the member to limit the amount of forward tilting of the member on the bracket.

* * * * *